US008736171B2

(12) United States Patent
Zhang et al.

(10) Patent No.: US 8,736,171 B2
(45) Date of Patent: May 27, 2014

(54) LIGHT EMITTING DIODE REPLACEMENT BULBS

(75) Inventors: Evan Zhang, Beavercreek, OH (US); Rusong Liu, Nanjing (CN); YiYang Zou, Dayton, OH (US)

(73) Assignee: Zybron Optical Electronics, Inc., Beavercreek, OH (US)

( * ) Notice: Subject to any disclaimer, the term of this patent is extended or adjusted under 35 U.S.C. 154(b) by 436 days.

(21) Appl. No.: 13/225,631

(22) Filed: Sep. 6, 2011

(65) Prior Publication Data

US 2012/0056536 A1 Mar. 8, 2012

Related U.S. Application Data

(60) Provisional application No. 61/379,902, filed on Sep. 3, 2010.

(51) Int. Cl.
*H01J 7/44* (2006.01)
*H01J 7/24* (2006.01)

(52) U.S. Cl.
USPC ..... 315/50; 315/71; 362/294; 362/373

(58) Field of Classification Search
USPC ..... 315/50, 52, 51, 291, 307, 309, 71; 362/294, 373, 800
See application file for complete search history.

(56) References Cited

U.S. PATENT DOCUMENTS 4,729,076 A 3/1988 Masami et al.
5,457,450 A 10/1995 Deese et al.
5,561,346 A 10/1996 Byrne
5,782,555 A 7/1998 Hochstein
5,785,418 A 7/1998 Hochstein
5,806,965 A 9/1998 Deese
5,850,126 A 12/1998 Kanbar
5,898,381 A 4/1999 Gartner et al.
5,949,347 A 9/1999 Wu
6,019,493 A 2/2000 Kuo et al.
6,036,336 A 3/2000 Wu
6,045,240 A 4/2000 Hochstein
6,054,932 A 4/2000 Gartner et al.
6,227,679 B1 5/2001 Zhang et al.
6,268,801 B1 7/2001 Wu
6,283,613 B1 9/2001 Schaffer
6,367,949 B1 4/2002 Pederson
6,517,218 B2 2/2003 Hochstein
6,567,010 B1 5/2003 Lin et al.
6,648,495 B1 11/2003 Hsu
6,827,475 B2 12/2004 Vetorino et al.
7,218,041 B2 5/2007 Isoda
7,270,446 B2 9/2007 Chang et al.
7,375,650 B2 5/2008 Lo (Continued)

*Primary Examiner* — David H Vu
(74) *Attorney, Agent, or Firm* — Thomas E. Lees, LLC

(57) ABSTRACT

An illumination device comprises a bulb connector, a body structure and an insulating layer between the bulb connector and a first end portion of the body structure. The illumination device further comprises a first plurality of light emitting diodes arranged towards the first end portion of the body structure and a second light source comprising at least one light emitting diode arranged towards the second end portion of the body structure. A heat sink extends from the body structure and a controller within the body structure receives power through the bulb connector and supplies power to each of the light emitting diodes. As such, the illumination device can directly replace an incandescent bulb. Thus for example, the illumination device can replace an incandescent bulb of a traffic light without requiring changes to the compartment, fixture, reflector, or window/lens.

20 Claims, 9 Drawing Sheets

(56) References Cited

U.S. PATENT DOCUMENTS

| | | | | |
|---|---|---|---|---|
| 8,100,552 | B2 * | 1/2012 | Spero | 362/231 |
| 8,506,126 | B2 * | 8/2013 | Quirion et al. | 362/289 |
| 2001/0030866 | A1 | 10/2001 | Hochstein | |
| 2002/0093820 | A1 | 7/2002 | Pederson | |
| 2005/0024875 | A1 | 2/2005 | Zhang | |
| 2005/0041428 | A1 | 2/2005 | Zhang | |
| 2005/0111234 | A1 | 5/2005 | Martin et al. | |
| 2005/0135107 | A1 | 6/2005 | Currie et al. | |
| 2006/0039150 | A1 | 2/2006 | Mayer et al. | |
| 2006/0092640 | A1 | 5/2006 | Li | |
| 2006/0139932 | A1 | 6/2006 | Park | |
| 2007/0081339 | A1 | 4/2007 | Chung et al. | |
| 2007/0081340 | A1 | 4/2007 | Chung et al. | |
| 2007/0091622 | A1 | 4/2007 | Huang et al. | |
| 2008/0013316 | A1 | 1/2008 | Chiang | |
| 2008/0025038 | A1 | 1/2008 | Chiang | |
| 2009/0135606 | A1 | 5/2009 | Young | |
| 2009/0244894 | A1 | 10/2009 | Zhou et al. | |
| 2009/0273921 | A1 | 11/2009 | Chiang | |
| 2009/0273924 | A1 | 11/2009 | Chiang | |
| 2010/0008086 | A1 | 1/2010 | Broitzman | |
| 2010/0020553 | A1 | 1/2010 | Teng et al. | |
| 2010/0039814 | A1 | 2/2010 | Germain | |
| 2011/0037409 | A1 * | 2/2011 | Van De Ven et al. | 315/294 |

* cited by examiner

LIGHT EMITTING DIODE REPLACEMENT BULBS

CROSS REFERENCE TO RELATED APPLICATIONS

This application claims the benefit of U.S. Provisional Patent Application Ser. No. 61/379,902, filed Sep. 3, 2010, entitled "LIGHT EMITTING DIODE REPLACEMENT BULBS", the disclosure of which is hereby incorporated by reference.

BACKGROUND

Various embodiments of the present invention relate in general, to illumination devices, and more particularly, to light emitting diode (LED) devices suitable for use in illumination applications, including uses as replacement bulbs in traffic lights and for home and industry lighting applications.

There are numerous applications that require light bulbs to be used in environments requiring frequent use, where changing a burned out light bulb can be cumbersome, expensive and/or otherwise inconvenient. For instance, a conventional traffic light provides three indicators, each indicator represented by a unique corresponding color. Typically, red is utilized as an instruction to stop, yellow is utilized as a warning of an impending stop instruction, and green is utilized as an instruction to go or otherwise travel.

A conventional traffic light houses three compartments, each compartment corresponding to a select one of the above-identified three colors. Within each compartment, an incandescent light bulb is typically utilized as the light source. Under this implementation, a reflector is mounted within the compartment behind the light bulb to reflect light from the incandescent light bulb out of the compartment through a color window or lens. However, the spectrum of light given off by an incandescent light bulb is broad and includes red, yellow and green light, as well as a fairly large percentage of infrared radiation. As such, to provide light at the appropriate color, a corresponding color cover lens is provided at the window in front of each light bulb to filter out the unwanted light so that only a single color, e.g., red, yellow or green light passes through. The remaining filtered energy is wasted as heat. As such, the efficiency of light emitted by a traffic light utilizing incandescent light sources is low. For example, the efficiency of a typical 100 W light bulb can be only about 2.6% or 17.5 lm/W (lumen per watt).

Additionally, in order to convert a typical traffic light to accommodate conventional light emitting diode (LED) bulbs, the whole fixture of the traffic light must be replaced, resulting in a conversion that is costly, labor intensive, and further requiring that traffic must be stopped during the installation.

BRIEF SUMMARY

According to aspects of the present invention, an illumination device comprises a bulb connector, a body structure having a first end portion and a second end portion and an insulating layer between the bulb connector and the first end portion of the body structure. The illumination device further comprises a first light source comprising a first plurality of light emitting diodes arranged towards the first end portion of the body structure, as well as a second light source comprising at least one light emitting diode arranged towards the second end portion of the body structure. Still further, the illumination device comprises a first reflector that is positioned about the first end portion of the body structure and a second reflector that is positioned about the second end portion of the body structure between the first light source and the second light source, where the second reflector is generally concave relative to the second light source. The illumination device also comprises a heat sink that extends from the body structure to draw away heat from at least one of the first and second light sources and a controller situated within the body structure that receives power through the bulb connector and supplies power to each of the light emitting diodes.

According to further aspects of the present invention, an illumination system comprises a lighting fixture and an illumination device. The lighting fixture comprises a compartment, a socket connector within the compartment, a window along an outside surface of the compartment opposite the socket connector and a compartment reflector within the compartment about the socket connector opposite the window. The illumination device comprises a screw base bulb connector, a body structure having a first end portion and a second end portion and an insulating layer between the bulb connector and the first end portion of the body structure. The illumination device also comprises a first reflector that is positioned about the first end portion of the body structure and a first light source comprising a first plurality of light emitting diodes arranged towards the first end portion of the body structure. The illumination device still further comprises a second reflector that is positioned about the second end portion of the body structure and a second light source comprising at least one light emitting diode arranged about the second end portion of the body structure. The illumination device also comprises a heat sink that extends from the body structure to draw away heat from at least one of the first and second light sources and a controller situated within the body structure that receives power through the bulb connector and supplies power to each of the light emitting diodes. In this regard, light emitted from the first and second light sources cooperate with the compartment reflector to produce an output of light that is uniform throughout its spot size through the window of the compartment.

According to still further aspects of the present invention, a traffic light comprises a traffic light housing having at least one illumination device compartment. Each compartment has a socket connector, a window that allows light to pass through from the compartment and a compartment reflector arranged around the socket connector so as to be generally concave relative to the window. The traffic light also comprises an illumination device installed in each socket connector. Each illumination device comprises a screw base bulb connector that screws into the socket connector, a body structure having a first end portion and a second end portion and an insulating layer between the bulb connector and the first end portion of the body structure. Each illumination device further comprises a first reflector that is positioned about the first end portion of the body structure and a first light source comprising a first plurality of light emitting diodes arranged towards the first end portion of the body structure. Each illumination device still further comprises a second reflector that is positioned about the second end portion of the body structure and a second light source comprising at least one light emitting diode arranged about the second end portion of the body structure. Moreover, each illumination device comprises a heat sink that extends from the body structure to draw away heat from at least one of the first and second light sources and a controller situated within the body structure that receives power through the bulb connector and supplies power to each of the light emitting diodes. In this regard, the first light source emits light that is reflected off at least one of the first reflector and the compartment reflector, before passing through the window and the second light source emits light at least some light that is reflected off the second reflector before passing through the window.

According to yet further aspects of the present invention, the illumination device, i.e., the light emitting diode bulb as described more fully herein, can be a direct, screw-in replacement for an incandescent bulb within a conventional traffic light, such that no part of the conventional traffic light fixture need be replaced, except for the light bulb.

DETAILED DESCRIPTION

Figure 1:
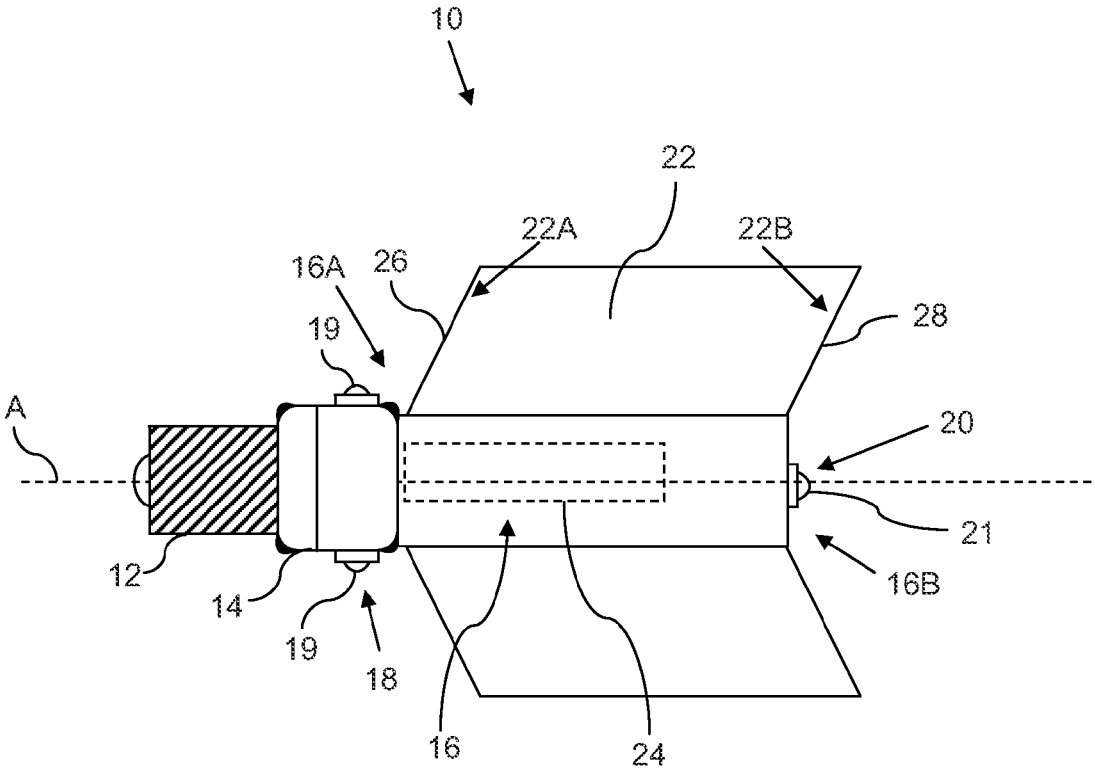
FIG. 1 is a view of a light emitting diode illumination device, according to various aspects of the present invention.

Referring now to the drawings, and in particular to FIG. 1, a light emitting diode-based illumination device 10 is illustrated, according to various aspects of the present invention. The illumination device 10 comprises in general, a bulb connector 12, an insulating layer 14 and a body structure 16. The bulb connector 12 defines a connector for receiving power from a suitable source. The body structure 16 houses the necessary electronics and supports a plurality of light emitting diodes, as will be described in greater detail below. The body structure 16 has a first end portion 16A and a second end portion 16B spaced apart by a middle portion. The insulating layer 14 is situated between the bulb connector 12 and the body structure 16. For instance, as illustrated, the insulating layer 14 is situated between the bulb connector 12, the first end portion 16A, and hence, the second end portion 16B of the body structure 16.

A first light source 18 comprising a first plurality of light emitting diodes 19 is arranged towards the first end portion 16A of the body structure 16. For instance, the first end portion 16A of the body structure 16 may have a generally circular cross-section. In this regard, the first plurality of light emitting diodes is arranged around the outer periphery of the first end portion 16A, e.g., defining an annular ring of lights. A second light source 20 comprising at least one light emitting diode 21 is arranged about the second end portion 16B of the body structure 16. For instance, in the illustrative example, one or more light emitting diodes 21 extends from an end face of the body structure 16. In the illustrative example, the second light source 20 is arranged generally coaxially with illumination device 10, as schematically illustrated by the dashed axis A. In this illustrative example, each of the first plurality of light emitting diodes 19 are arranged in a radial direction about the outer periphery of the body structure 16, and are thus each generally perpendicular in orientation relative to the light emitting diode 21 of the second light source 20.

A heat sink 22 extends from the body structure 16. The heat sink 22 draws heat away from the first light source 18, the second light source 20 or both the first and second light sources 18, 20. In the illustrative example, the heat sink 22 comprises a plurality of heat sinking fins that extend from an outer periphery of the body structure 16. More particularly, the heat sink 22 comprises a plurality of conductive fins that each extend axially along at least a portion of the body structure 16, and project out in a general radial direction from the outer periphery of the body structure 16.

In an illustrative implementation, the body structure 16 is implemented as a hollow metal structure. Moreover, as will be described in greater detail herein, a controller 24 is situated within the hollowed portion of the body structure 16. The insulating layer 14 comprises an electric insulation layer such as plastic or other suitable material that spaces the bulb connector 12 from the hollow metal structure implementing the body structure 16. Moreover, in this illustrative implementation, the heat sink 22 is implemented as a plurality of thermal fins that project from the hollow metal structure.

Continuing with the illustrative example, the first light source 18 comprises at least four light emitting diodes 19 that are arranged around the bottom of the metal structure defining the body structure 16. Correspondingly, the second light source 20 is implemented using at least one light emitting diode 21 that is positioned at the top of the metal structure, opposite of the bulb connector 12. As the first and second light sources 18, 20 are each comprised of light emitting diodes mounted about the metal body structure 16, the metal housing of the body structure 16 in combination with the thermal fins of the heat sink 22 draw and dissipate heat generated by the light emitting diodes 19, 21 to keep the light emitting diodes cool and extend their usable service life.

According to further aspects of the present invention, the illumination device 10 further comprises a first reflector 26 that is positioned about the first end portion 16A of the body structure 16. According to still further aspects of the present invention, the illumination device 10 comprises a second reflector 28 that is positioned about the second end portion 16B of the body structure. The first reflector 26 and/or the second reflector 28 thus enable light emitted by the first light source 18 and the second light source 22 to be redirected from the illumination device 10 at a desired angle, as will be described in greater detail herein.

Figure 2:
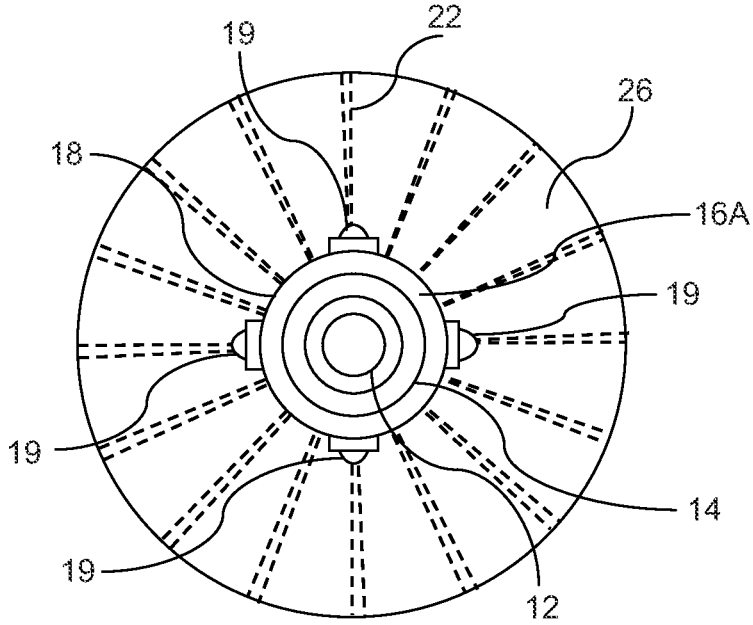
FIG. 2 is a bottom view of the light emitting diode illumination device illustrated in FIG. 1, according to various aspects of the present invention.

Referring to FIG. 2, the illumination device 10 is illustrated in a bottom view looking into the bulb connector 12 along axis A of the illumination device 10. In the illustrative example, the bulb connector 12, the insulating layer 14, and the first end portion 16A of the body structure 16 all have a generally circular cross-section. Moreover, the first light source 18 is illustrated as comprising at least four light emitting diodes 19, each generally evenly spaced around the outer periphery of the first end portion 16A of the body structure 16 proximate to the reflector 26. In this regard, light from the light emitting diodes 19 is emitted out is a generally radial direction relative to a longitudinal direction of the body structure 16, e.g., and thus relative to the dashed axis A. However, in practice, any number of light emitting diodes may be provided about the outer periphery of the first end portion 16A of the body structure 16. Still further, although illustrated as only having a single row of light emitting diodes, in practice, any number of rows of light emitting diodes may be provided.

According to further aspects of the present invention, the reflector 26 may be approximately 'r-shaped', or the reflector 26 can take on other shapes to facilitate the desired overall light pattern. For instance, as will be described in greater detail herein, the illumination device 10 may be used in a fixture having a housing and a relatively large housing reflector. As such, the reflector 26 can be shaped to let more light reflect to the larger, housing reflector, such as to form a uniform spot, or to form a spot that is more uniform than what could otherwise be achieved with a conventional configuration. Still further, the light emitting diodes may be provided about the outer periphery of the first end portion 16A of the body structure 16 need not be oriented so as to face in a radial direction. Rather, the light emitting diodes may be angled or otherwise adjusted in orientation to achieve a desired overall light pattern.

Referring to FIGS. 1 and 2 in general, the first reflector 26 circumscribes and extends angularly outward from the outer periphery of the body structure 16 so as to provide a reflection surface for the first plurality of light emitting diodes 19 of the first light source 18. In an illustrative implementation, an r-shape of the first reflector 26 defines a circular reflector (in cross-section) to reflect at least a portion of light emitted by the first light source 18. As a few additional illustrative examples, the r-shaped first reflector 26 may have a reflective wall extending angularly outward from the periphery of the body structure 16. The r-shaped first reflector 26 may also be curved, e.g., defining a convex or a concave reflection surface relative to the first plurality of light emitting diodes. Moreover, the lower edge 22A of the fins defining the heat sink 22 may have a contour that generally corresponds to the contour of the r-shaped first reflector 26.

Figure 3:
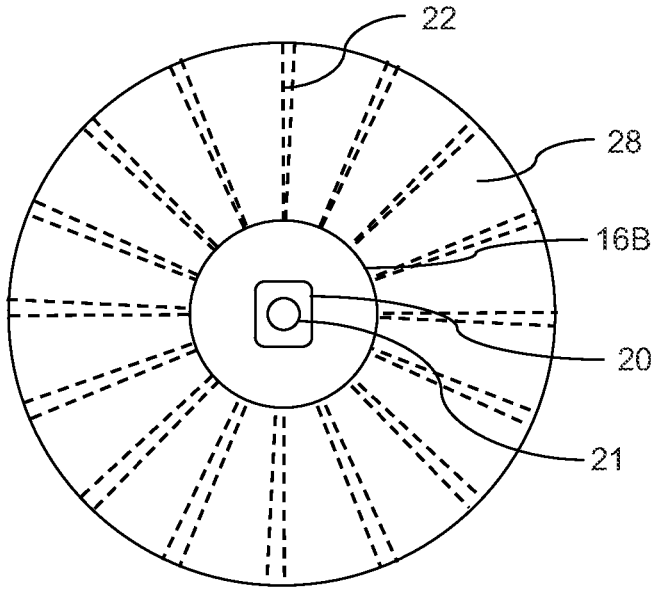
FIG. 3 is a top view of the light emitting diode illumination device illustrated in FIG. 1, according to various aspects of the present invention.

Referring to FIG. 3, the illumination device 10 is illustrated in a top view looking into the second light source 20 along the axis A of the illumination device 10. In the illustrative example, the second light source 20 is illustrated as comprising at least one light emitting diode 21, positioned generally centered axially at the face of the terminal end of the second end portion 16B of the body structure 16. However, in practice, any number of light emitting diodes may be provided about the outer periphery and/or face of the second end portion 16B of the body structure 16. The second light source 20 extends from an end face of the body structure 16 generally coaxially with the illumination device so as to emit light that extends generally perpendicular in orientation relative to the light emitted by the first plurality of light emitting diodes 19 of the first light source 18.

Referring to FIGS. 1 and 3 in general, the second reflector 28 is positioned about the second end portion 16B of the body structure 16 between the first light source 18 and the second light source 20. As illustrated, the second reflector 28 generally concave relative to the second light source 20. Moreover, the second reflector 28 circumscribes and extends angularly outward from the outer periphery of the body structure 16 so as to provide a reflection surface for the second light source 20. As a few illustrative examples, the second reflector 28 may have a reflective wall extending angularly outward from the periphery of the body structure 16, e.g., towards the second end portion of the body structure 16. The second reflector 28 may also be curved, e.g., defining a concave or a convex reflection surface relative to the second light source 20.

Moreover, in an exemplary and illustrative implementation, the upper edge 22B of the fins defining the heat sink 22 has a contour that generally corresponds to the contour of the second reflector 28. Thus, in an illustrative implementation, the fins 22 link the r-shaped first reflector 26 and the second reflector 28. In this regard, as illustrated, the heat sink is comprised of at least the fins 22, the first reflector 26 and the second reflector 28, along with the hollow metal body structure 16.

Figure 4:
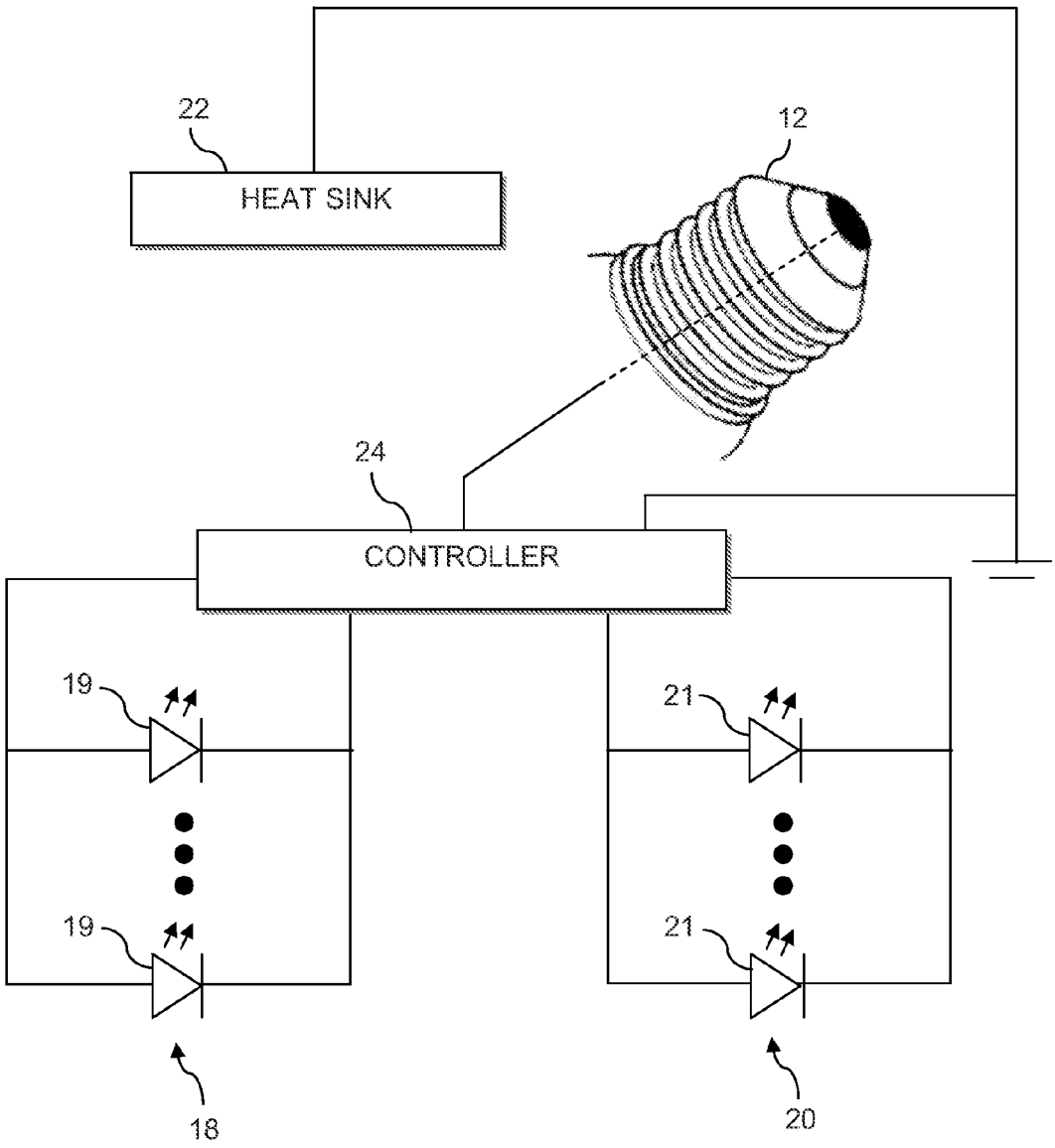
FIG. 4 is a schematic illustration of a power supply coupled to light emitting diodes of the light emitting diode illumination device illustrated in FIG. 1, according to various aspects of the present invention.

Referring to FIG. 4, the bulb connector 12 may comprise a screw base connector such as an E27 spiral screw base connector. In applications of the illumination source 10 such as a traffic light bulb, an existing conventional incandescent bulb can be unscrewed from its connector socket and the illumination device 10 can simply be screwed in as a direct replacement.

The connector 12 supplies power from a corresponding socket connection to the controller 24. The controller 24 receives power through the bulb connector 12 and supplies power to each of the light emitting diodes 19 of the first light source 18 and the light emitting diode(s) 21 of the second light source 20. In an illustrative example, the bulb connector 12 comprises an E27 spiral screw base connector that couples an alternating current voltage to the controller 24. Accordingly, the controller 24 includes AC to DC conversion circuitry, filtering circuitry, regulation circuitry, constant current circuitry, etc., which is necessary to convert power from the socket to a form of power suitable for driving the light emitting diodes 19, 21. The specific implementation of the controller circuitry will thus depend upon the specific implementation of the illumination device 10 and the source of power intended to be supplied to the illumination source.

In an illustrative example, the controller 24 comprises a switch mode power supply unit mounted inside the hollow shell of the body structure 16. The switch mode power supply converts 110 V or 220 VAC from an electrical line to a few volts DC to supply constant current to the light emitting diodes 19, 21. The regulation of the high voltage AC to low voltage DC prevents irregularities or changes to the intensity or brightness of the light emitting diodes 19 implemented by the first light source 18 and the light emitting diode(s) 21 implemented by the second light source 20 to environmental changes. Thus for example, changes to the voltage on the power line and changes in the temperature of environment will not adversely affect the brightness of the illumination device 10.

In this illustrative example, the insulation layer 14 is provided between the bulb connector 12 and the metal body structure 16. The insulation layer provides insulation from the main line power delivered to the illumination device 10 though the socket connector 12, e.g., when the illumination device 10 is being installed or removed from a corresponding socket. As such, the heat sink 22 is isolated from the socket connector 12 so that the device 10 can be held by hand for installation. Still further, an electrical insulation glove may be worn when changing the illumination device 10. The insulation layer 14 and/or the use of an insulating glove may prevent the possibility or reduce the likelihood of electrical shock if there is an electrical bridge between the power line and the heat sink even though the heat sink is connected to the electrical source neutral. In this regard, the controller 24 may also include a fuse, breaker or other device that will automatically shut off power to the illumination device 10 should a short or conductive path occur between the power supply and the heat sink 22.

Figure 5:
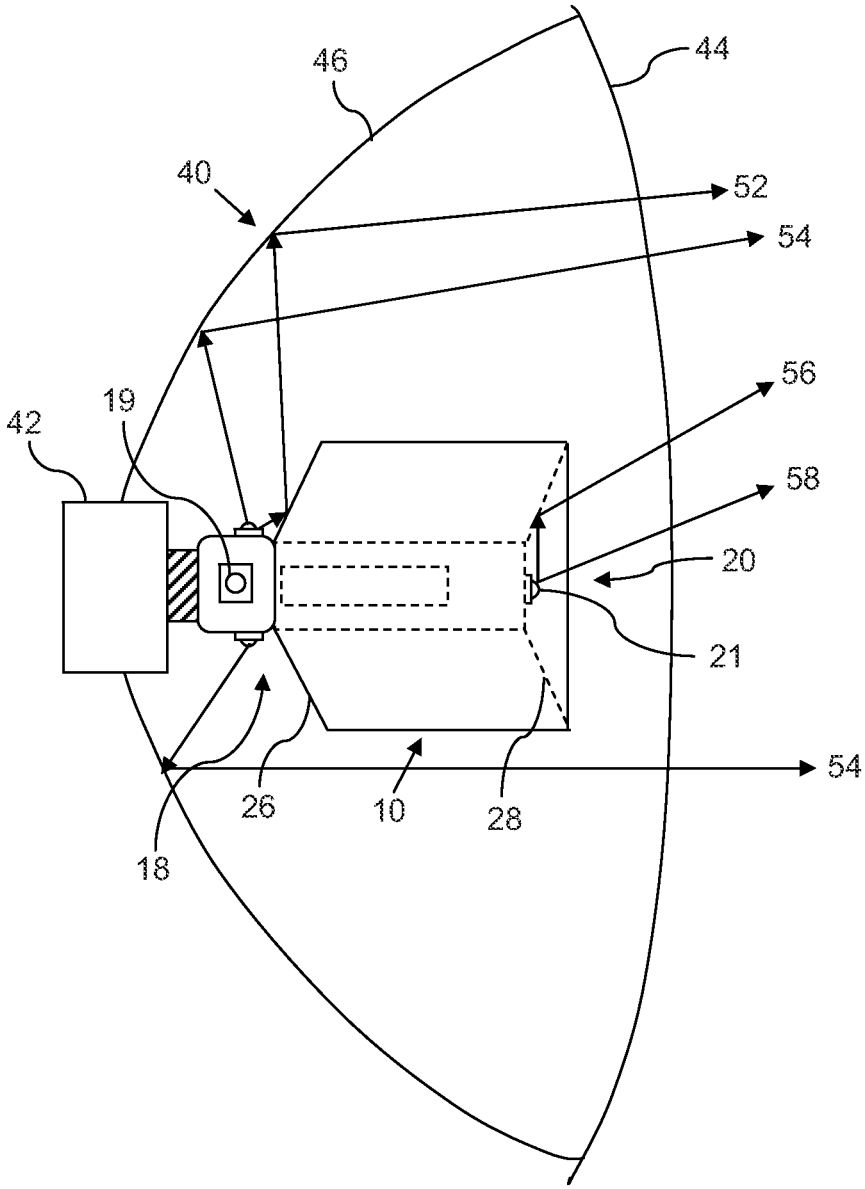
FIG. 5 is an illustration of a light emitting diode illumination device mounted in a reflector, e.g., of a traffic light, according to various aspects of the present invention.

Referring to FIG. 5, an illumination system includes the illumination device 10 installed in a light fixture 40. The light fixture 40 may comprise for example, a compartment, e.g., within traffic light housing or other device. The illustrated compartment comprises in general, a socket connector 42, a window 44 and a compartment reflector 46. The socket connector 42 is positioned within the compartment and the window 44 is positioned along an outside surface of the compartment opposite the connector socket 42. The reflector 46 is positioned within the compartment about the socket connector 42 opposite the window.

The socket connector 42 includes a socket connection that mates with the bulb connector 12 of the illumination device 10. For instance, the socket connector 42 may comprise a female spiral screw base connector that mates with the spiral screw bulb connector 12 of the illumination device 10. The window 44 allows light emitted by the illumination device 10 to pass through from the compartment. In this regard, the window 44 may include filters, lenses and/or other features suitable for the intended use of the light fixture 40. The compartment reflector 46 may comprise for example, a parabolic reflector, and is arranged around the socket connector 42 so as to be generally concave relative to the window 44. Thus, the inner wall of the compartment reflector 46 surrounds the illumination device 10 when illumination device 10 is properly secured to the socket connector 42.

In an exemplary implementation, the first reflector 26 comprises a generally r-shaped configuration. In this regard, light from the first light source 18, i.e., light from the first plurality of light emitting diodes 19, is emitted such that a portion of the light may be reflected off the r-shaped first reflector 26 before being reflected by the compartment reflector 46 so as to direct the light out the window 44 as schematically indicated by the ray trace 52. Similarly, light from the first light source 18, i.e., light emitted by the first plurality of light emitting diodes 19, may reflect directly off of the compartment reflector 46 before being directed out the window 44 as schematically illustrated by the ray trace 54.

Light emitted from the second light source 20, i.e., light from the light emitting diode(s) 21, is emitted such that a portion may be reflected off of the second reflector 28 before being directed out the window 44 as indicated by the ray trace 56. Also, light emitted by the second light source 20, i.e., light emitted by the light emitting diode(s) 21, is directed directly out the window 44 as indicated by the ray trace 58. The combination of light provided by the first and second light sources 18, 20 provide an output of light that is uniform throughout its spot size.

The first light source 18, the second light source 20, the first reflector 26, the second reflector 28, and the compartment reflector 44 can be configured to cooperate to reflect light from the various light emitting diodes 19, 21 in such a way that the light is primarily directed at a specific angle suitable for a particular application. For instance, light emitted from the first and second light sources 18, 20 cooperate with the compartment reflector to produce an output of light that is uniform throughout its spot size through the window of the compartment. This ability provides a benefit over other light emitting diode based lights, which suffer from inconsistent uniformity in intensity within a spot.

Most of the light emitted by the illumination device 10 is derived from the first light source 18, via the plurality of light emitting diodes 19 reflecting off the first reflector 26 and/or the compartment reflector 46, as seen by the ray traces 52, 54. The light emitted by the second light source 20 is utilized to compensate for the missing central light from the illumination device 10 due to the physical dimensions of the body structure 16 and corresponding heat sink 22. The second light device 20 emits light that travels directly in a desired direction and/or is a portion first reflected off of the second reflector 28 before being directed in a desired direction. Accordingly, the illumination device 10, e.g., using as few as 5 light emitting diodes 19, 21, emits light with sufficient intensity to uniformly project on a conventional cover lens 44 to illuminate a required distance within a desired angle in a typical traffic light application.

Light emitting diodes include a PN junction that will emit light at specific wavelength. Different material with different PN junctions will emit different wavelengths of lights. Since the light emitting diodes utilized to implement the first and second light sources 18, 20 can create a desired color, e.g., red, yellow or green, the window 44 need not be tinted or filtered to obtain a desired color of light, and thus a color cover lens is not necessary for traffic light applications. In a retrofit installation where a color filter/lens is already present, the colored window can be kept in place because the lens having a color that is generally the same as that of the light emitting diode will not waste too much energy as heat due to filtering. As such, the light emitted by an illumination device 10 used in a traffic light has a much higher efficiency than a comparable conventional incandescent traffic light.

By way of illustration, and not by way of limitation, an 8-watt implementation of the illumination source 10 can meet or exceed all standards and specifications of a 100-watt incandescent traffic bulb. The screw base connector 12 can be adapted to other socket form factors so as to make the illumination source 10 a direct replacement for a conventional incandescent lamp or bulb.

Thus, an illumination device 10 is provided, which enables retention of the older legacy reflector, cover lens and conventional traffic light fixture. This minimizes the labor and material costs of transitioning from conventional incandescent light bulbs to illumination devices 10. According to aspects of the present invention, the illumination device 10 is a direct replacement of an old incandescent bulb, even having a similar bulb shape with the same E27 spiral shape connector as the incandescent bulb. Thus, replacement comprises a simple act to screw out the old incandescent bulb and screw in the illumination device 10. After screwing in the illumination device 10, the task is complete. Notably, there is no requirement to cut the line power and no requirement to significantly stop or impede traffic because the bulb replacement only needs a few seconds by using a motorized lift on a truck sitting at the road side. However, conventional LED traffic lights can require that a user must change the whole compartment including fixture, reflector, lens, etc to accommodate use of such conventional LED bulbs. As such, traffic must be stopped, potentially for an extended period of time, while the work is being performed. Moreover, the power line must be cut. As such, the labor and material costs are significantly higher than replacement cost using the illumination device 10 described herein.

Moreover, as noted above, the power consumption of the illumination device 10 can be on the order of around 8-watts compared to the 100-watts of a conventional incandescent bulb. That results in an energy savings of over 90%. Still further, the life of the illumination device is measured on the order of years, e.g., 10 years or more compared to the lifespan measured on the order of months for certain conventional incandescent bulbs. Further, the labor and maintenance savings are far more than the energy saving.

Figure 6:
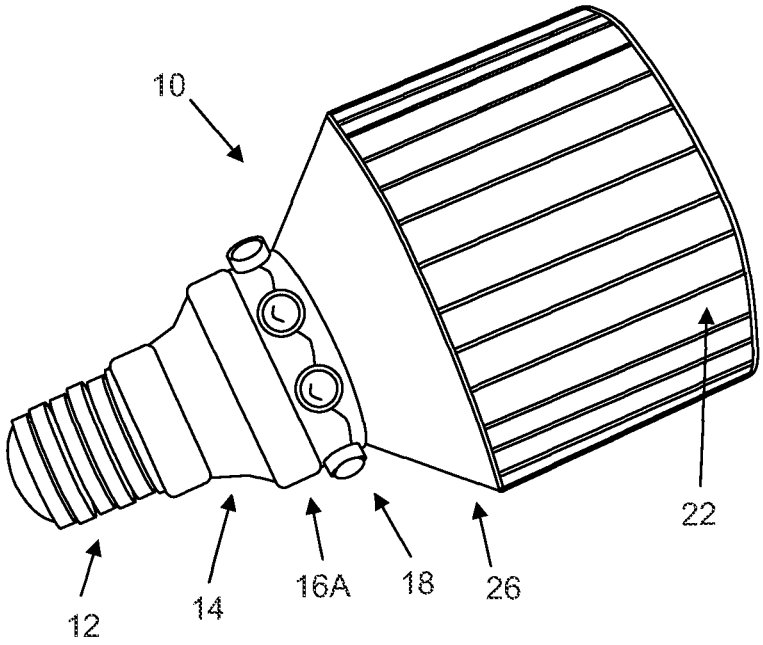
FIG. 6 is an illustration of a light emitting diode illumination device, according to various aspects of the present invention.
Figure 7:
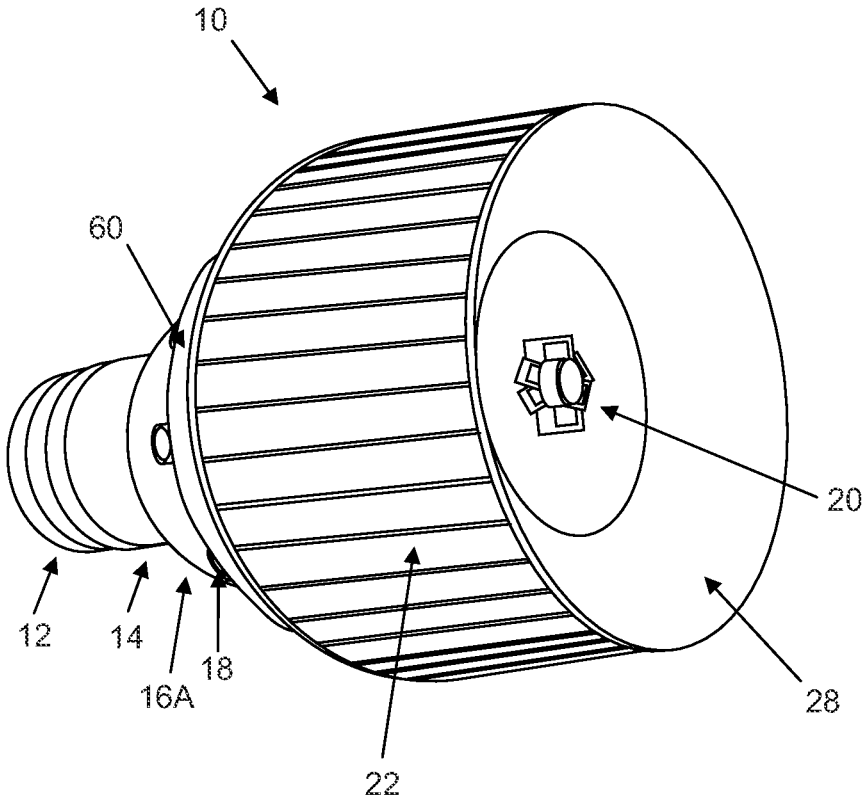
FIG. 7 is an illustration of the light emitting diode device of FIG. 6, according to various aspects of the present invention.

Referring to FIGS. 6 and 7 schematic illustrations are provided for exemplary implementations of the illumination device 10, according to various aspects of the present invention. The illumination device of FIG. 7 is identical to the illumination device of FIG. 6 except that in FIG. 7, the reflection surface 26 includes an extra reflection surface component 60 so that the first reflector 26 forms an r-shape as described more fully herein. That is, the reflection surface component 60 can project, cantilever, hook, curve, umbrella out or otherwise extend from the body structure 16 such that the first reflector 26 is in the general shape of an 'r'. Regardless, this 'r-shape' is configured to direct relatively more light from the light emitting diodes 19 to reflect off of the first reflector 26 back into a larger reflector contained in a corresponding fixture, such as a traffic light. As a result, a more uniform light pattern is achieved when the illumination device 10 is utilized in cooperation with a light fixture having a large reflector within the fixture housing.

Figure 8:
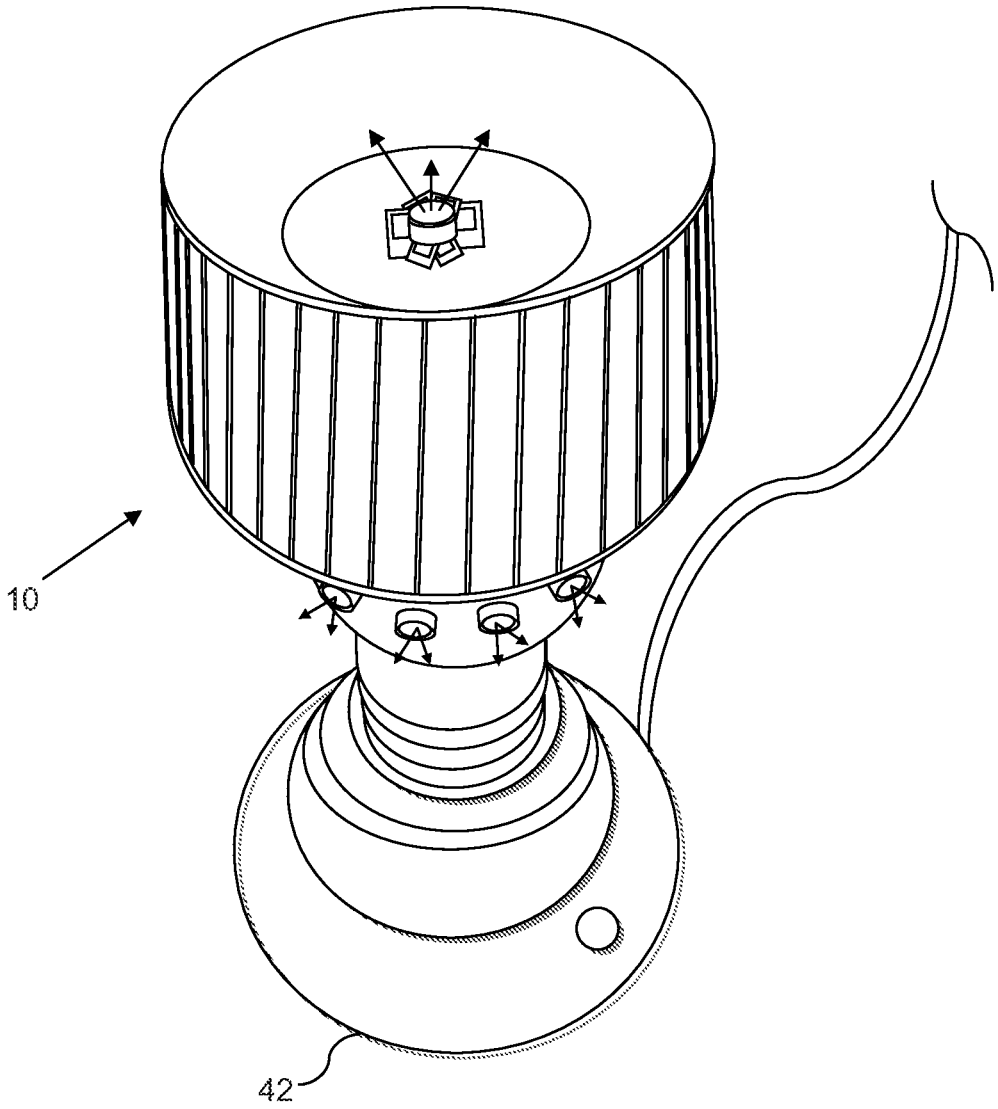
FIG. 8 is an illustration of the light emitting diode device of FIG. 6, illuminating light according to various aspects of the present invention.
Figure 9:
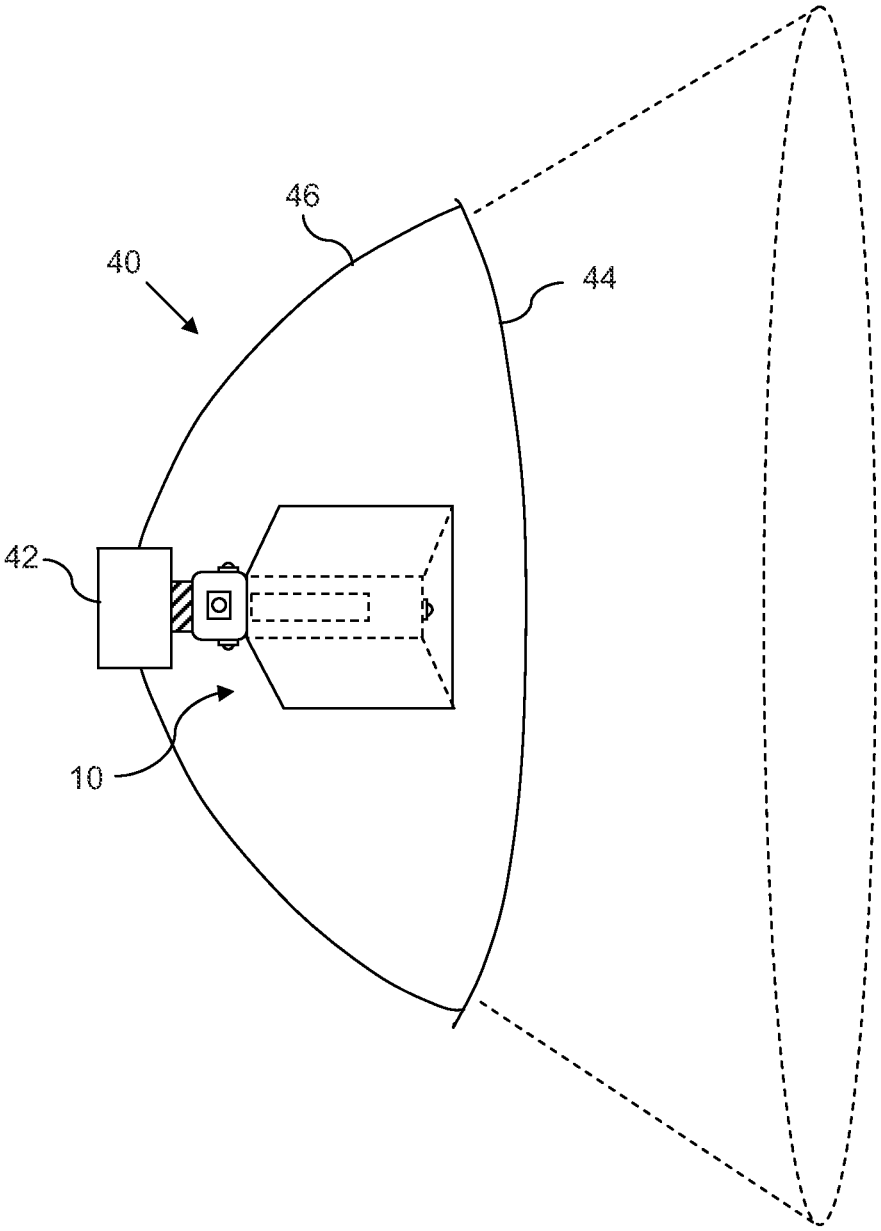
FIG. 9 is an illustration of the light emitting diode device of FIG. 6, illustrating a uniform illumination pattern, according to various aspects of the present invention.

Referring to FIG. 8, the illumination device 10 of FIGS. 6 and 7 is installed in a corresponding connector socket 42. The illumination device 10 is powered on and is schematically illustrated as emitting light, e.g., red light, yellow light or green light. Referring to FIG. 9, the illumination device 10 of FIGS. 6, 7 and 8, is illustrated as illuminating a uniform a spot pattern as schematically represented by the dashed lines.

Figure 10:
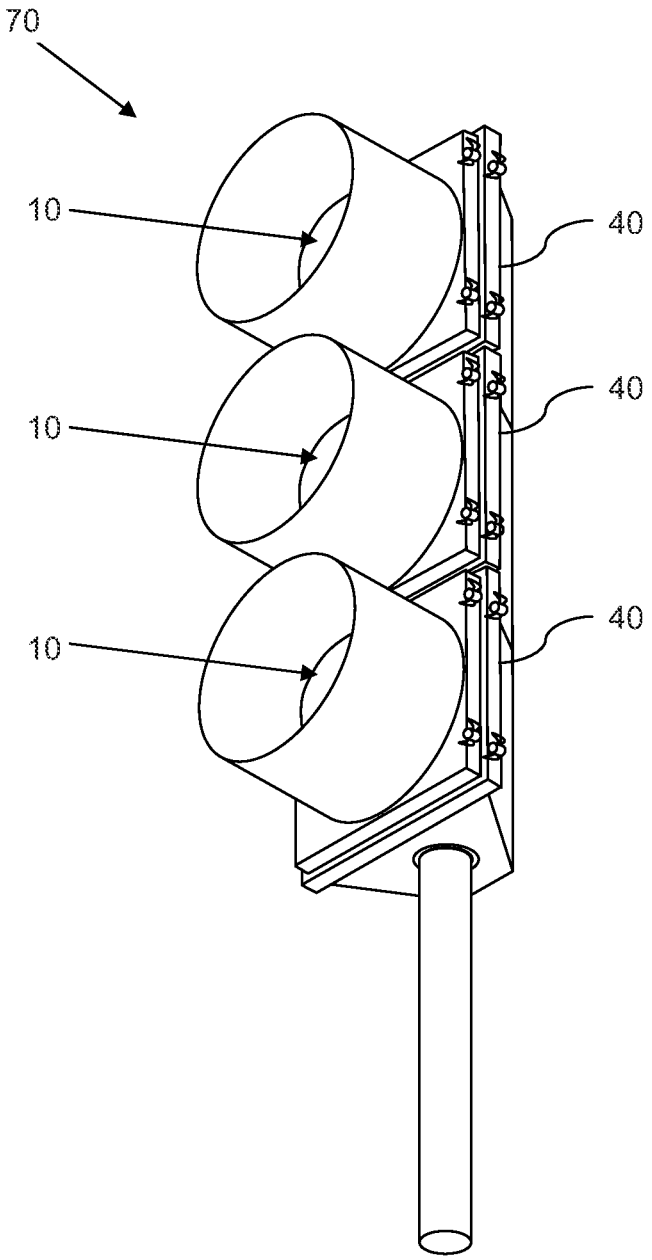
FIG. 10 is an illustration of an exemplary LED traffic light having illumination devices according to various aspects of the present invention.

Referring to FIG. 10, illumination devices 10 are utilized to implement the illumination of a traffic light. A traffic light 70 comprises a traffic light housing having at least one illumination device compartment 40. There are three compartments 40 as illustrated traffic light 70, representing a red light, yellow light and green light. Each compartment 40 comprises a socket connector, a window, a compartment reflector and an illumination source 10, e.g., as described more fully herein. Moreover, the illumination device 10 corresponding to the red light can include red light emitting diodes 19, 21. Similarly, the illumination device 10 intended for the yellow light can include yellow light emitting diodes 19, 21, and the illumination device 10 intended for the green light can include green light emitting diodes 19, 21. This arrangement, while not a requirement, enables illumination devices 10 that are optimized for efficiency, as described in greater detail herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Having thus described the invention of the present application in detail and by reference to embodiments thereof, it will be apparent that modifications and variations are possible without departing from the scope of the invention defined in the appended claims.

What is claimed is:

1. An illumination device, comprising:

a bulb connector;

a body structure having a first end portion and a second end portion;

an insulating layer between the bulb connector and the first end portion of the body structure;

a first light source comprising a first plurality of light emitting diodes arranged towards the first end portion of the body structure;

a first reflector that is positioned about the first end portion of the body structure;

a second light source comprising at least one light emitting diode arranged towards the second end portion of the body structure;

a second reflector that is positioned about the second end portion of the body structure between the first light source and the second light source, the second reflector generally concave relative to the second light source;

a heat sink that extends from the body structure to draw away heat from at least one of the first and second light sources; and a controller situated within the body structure that receives power through the bulb connector and supplies power to each of the light emitting diodes.

2. The illumination device according to claim 1, wherein the bulb connector comprises an E27 spiral screw base connector that couples an alternating current voltage to the controller.

3. The illumination device according to claim 1, wherein:

the first reflector is generally r-shaped; and the first plurality of light emitting diodes comprises at least four light emitting diodes, each generally evenly spaced around the outer periphery of the first end portion of the body structure proximate to the first reflector, such that light from the first plurality of light emitting diodes is emitted out is a generally radial direction relative to a longitudinal direction of the body structure.

4. The illumination device according to claim 3, wherein the first reflector circumscribes and extends angularly outward from the outer periphery of the body structure so as to provide a reflection surface for the first plurality of light emitting diodes.

5. The illumination device according to claim 3, wherein the second light source extends from an end face of the body structure 16 generally coaxially with the illumination device so as to emit light that extends generally perpendicular in orientation relative to the light emitted by the first plurality of light emitting diodes of the first light source.

6. The illumination device according to claim 5, wherein the second reflector circumscribes and extends angularly outward from the outer periphery of the body structure so as to provide a reflection surface for the second light source.

7. The illumination device according to claim 5, wherein the heat sink comprises a plurality of heat sinking fins that extend from an outer periphery of the body structure and between the first reflector and the second reflector.

8. The illumination device according to claim 1, wherein the illumination device is configured to direct light emitted by the light emitting diodes in a predetermined direction that is at an angle relative to an axis of the body structure such that the light emitted by the illumination device forms a uniform spot.

9. The illumination device according to claim 1, further comprising:

a first reflector that is positioned about the first end portion of the body structure that is generally convex relative to the insulating layer and provides a reflection surface for the first plurality of light emitting diodes; and a second reflector that is positioned about the second end portion of the body structure that is generally concave relative to, and provides a reflection surface for, the second light source;

wherein:

the heat sink comprises a plurality of fins having a contour that generally corresponds to the contour of the first reflector and the second reflector; and the fins link the first reflector and the second reflector.

10. The illumination device according to claim 9, wherein select ones of the first reflector, second reflector, first light source and second light source of the illumination device are configured to direct light emitted by the light emitting diodes in a predetermined direction that is at an angle relative to an axis of the body structure so as to form a uniform spot.

11. An illumination system, comprising:

a lighting fixture having:

a compartment;

a socket connector within the compartment;

a window along an outside surface of the compartment opposite the socket connector; and a compartment reflector within the compartment about the socket connector opposite the window; and an illumination device comprising:

a screw base bulb connector;

a body structure having a first end portion and a second end portion;

an insulating layer between the bulb connector and the first end portion of the body structure;

a first reflector that is positioned about the first end portion of the body structure;

a first light source comprising a first plurality of light emitting diodes arranged towards the first end portion of the body structure;

a second reflector that is positioned about the second end portion of the body structure;

a second light source comprising at least one light emitting diode arranged about the second end portion of the body structure;

a heat sink that extends from the body structure to draw away heat from at least one of the first and second light sources; and a controller situated within the body structure that receives power through the bulb connector and supplies power to each of the light emitting diodes;

wherein:

light emitted from the first and second light sources cooperate with the compartment reflector to produce an output of light that is uniform throughout its spot size through the window of the compartment.

12. The illumination device according to claim 11, wherein the bulb connector comprises an E27 spiral screw base connector.

13. The illumination device according to claim 11, wherein:

the first reflector is generally r-shaped; and the first reflector circumscribes and extends angularly outward from the outer periphery of the body structure so as to provide a reflection surface for the first plurality of light emitting diodes.

14. The illumination device according to claim 11, wherein the first plurality of light emitting diodes comprises at least four light emitting diodes.

15. The illumination device according to claim 11, wherein the second reflector circumscribes and extends angularly outward from the outer periphery of the body structure so as to provide a reflection surface for the second light source.

16. The illumination device according to claim 11, wherein the heat sink comprises a plurality of heat sinking fins that extend from an outer periphery of the body structure.

17. The illumination device according to claim 11, wherein the illumination device is configured to direct light emitted by the light emitting diodes in a predetermined direction that is at an angle relative to an axis of the body structure.

18. A traffic light comprising:

a traffic light housing having at least one illumination device compartment, each compartment having:

a socket connector;

a window that allows light to pass through from the compartment; and a compartment reflector arranged around the socket connector so as to be generally concave relative to the window;

an illumination device, comprising:

a screw base bulb connector that screws into the socket connector;

a body structure having a first end portion and a second end portion;

an insulating layer between the bulb connector and the first end portion of the body structure;

a first reflector that is positioned about the first end portion of the body structure;

a first light source comprising a first plurality of light emitting diodes arranged towards the first end portion of the body structure;

a second reflector that is positioned about the second end portion of the body structure;

a second light source comprising at least one light emitting diode arranged about the second end portion of the body structure;

a heat sink that extends from the body structure to draw away heat from at least one of the first and second light sources; and a controller situated within the body structure that receives power through the bulb connector and supplies power to each of the light emitting diodes;

wherein:

the first light source emits light that is reflected off at least one of the first reflector and the compartment reflector, before passing through the window and the second light source emits light at least some light that is reflected off the second reflector before passing through the window.

19. The illumination device according to claim 18, wherein the illumination device is configured to direct light emitted by the light emitting diodes in a predetermined direction that is at an angle relative to an axis of the body structure.

20. The illumination device according to claim 18, wherein the bulb connector is configured such that the illumination device can directly replace an incandescent bulb of a traffic light without requiring changes to the compartment, fixture, reflector, or window/lens.

* * * * *